US006564992B1

(12) United States Patent
Wegner

(10) Patent No.: US 6,564,992 B1
(45) Date of Patent: May 20, 2003

(54) COMBINATION PRODUCT PACKAGE AND DISPOSABLE COOLER

(75) Inventor: Kenneth E. Wegner, Elmhurst, IL (US)

(73) Assignee: The Jel Sert Company, West Chicago, IL (US)

( * ) Notice: Subject to any disclaimer, the term of this patent is extended or adjusted under 35 U.S.C. 154(b) by 6 days.

(21) Appl. No.: 09/713,608

(22) Filed: Nov. 15, 2000

(51) Int. Cl.[7] ..... B65D 5/46; B65D 5/56
(52) U.S. Cl. ..... 229/117.35; 62/457.5
(58) Field of Search ..... 229/117.35; 62/457.1, 62/457.5, 457.7; 220/523

(56) References Cited

U.S. PATENT DOCUMENTS 2,006,705 A * 7/1935 Bangs ..... 229/117.35
2,844,299 A * 7/1958 Kessler et al. ..... 62/457.5
2,979,227 A * 4/1961 Norton et al. ..... 62/457.5
5,042,260 A * 8/1991 George, Sr. ..... 62/457.5
5,094,359 A * 3/1992 DeMars et al. ..... 229/117.35
5,263,339 A * 11/1993 Evans ..... 62/457.7
5,441,170 A * 8/1995 Bane, III ..... 229/117.35
5,558,214 A * 9/1996 Brundidge ..... 220/523
5,615,795 A * 4/1997 Tipps ..... 229/117.35
5,758,513 A * 6/1998 Smith ..... 62/457.5

OTHER PUBLICATIONS

The Wiley Encyclopedia of Packaging Technology, John Wiley & Sons, pp. 66–69, 74, 75 (1986).*

* cited by examiner

*Primary Examiner*—Gary E. Elkins
(74) *Attorney, Agent, or Firm*—Olson & Hierl, Ltd.

(57) ABSTRACT

A combination point-of-purchase package and point-of-use disposable cooler for beverage containers, such as bottles or the like, which is a container provided with a separate, liquid impervious liner therein. The beverage containers are stored in the container and enveloped by the liner at the point-of-purchase. A spacer in the container but removable therefrom is provided to create a space in the container for receiving a cooling medium such as ice for cooling the beverage containers.

12 Claims, 3 Drawing Sheets

11
24
24
34
22
18
12
14
21
10

11
24
34
18
12
10
14

COMBINATION PRODUCT PACKAGE AND DISPOSABLE COOLER

FIELD OF THE INVENTION

This invention relates to a product package and, more particularly, to a combination point-of-purchase product package and disposable point-of-use cooler.

BACKGROUND OF THE INVENTION

Manufacturers and retailers use various types of point-of-purchase packages to store and hold their goods and products at the point-of-purchase such as, for example, supermarkets or the like. An example of one such package is the carton which manufacturers use to package and store cans or bottles of liquid refreshments or the plastic rings which canners use to wrap and hold together cans of liquid refreshments.

A disadvantage associated with these types of packages, however, is that, where the liquid refreshment contained in such cans or bottles is to be cooled prior to consumption, the cans and/or bottles must first be removed from the point-of-purchase package and placed into a refrigerator or a separate disposable cooler filled with ice or other appropriate cooling medium.

The present invention overcomes this disadvantage by providing a package which can be used both to store the bottles and/or cans at the point-of-purchase and also for cooling the bottles and/or cans at the point of use.

SUMMARY OF THE INVENTION

A combination point-of-purchase package and point-of-use disposable cooler for beverage containers, such as bottles or the like, includes a container, such as a box, made of a disposable material, such as corrugated paper, and a liquid impervious liner in the interior of the container. The liner envelops the beverage containers at the point-of-purchase and is adapted to receive ice or the like cooling medium for cooling the contents, of the beverage containers prior to use.

In one embodiment, a removable spacer is located in the interior of the container and creates a gap or space in the container between the beverage containers and into which ice or a similar cooling medium, e.g., a refreezable ice pack, can be introduced. The spacer can be disposed centrally in the interior of the container between the front and back walls thereof. Alternatively, two or more spacers are located in the interior of the container along and in abutting relationship with the front and back walls of the container respectively. The spacers, when removed, create gaps or volumes adapted to receive ice or the like coolant. The volume adapted to receive coolant is at least 10 percent of the total interior volume of the cooler, preferably about 13 to about 20 percent of the total interior volume of the cooler.

Other features and advantages of the present invention will become readily apparent from the following attached description; the appended drawings, and the accompanying claims.

DETAILED DESCRIPTION OF THE PREFERRED EMBODIMENTS

This invention may be used in many different forms. The specification and the accompanying drawings disclose only two exemplary embodiments of the present invention. The invention, however, is not to be limited to the specific embodiments illustrated and the scope of the invention will be pointed out in the appended claims.

Moreover, the precise shapes, sizes and structure of the components herein described are not necessarily essential to the invention unless otherwise indicated. For example, in the disclosed embodiments, the containers are generally rectangularly shaped and sized to store plastic bottles, the containers are made of corrugated paper, and the liners are made of plastic material. It is understood, however, that the present invention encompasses, containers and liners of different shapes and sizes for storing and cooling differently shaped and sized bottles or other items and further that the container and the liner may be made of any other material suitable for the intended purposes of the present invention.

Figure 1:
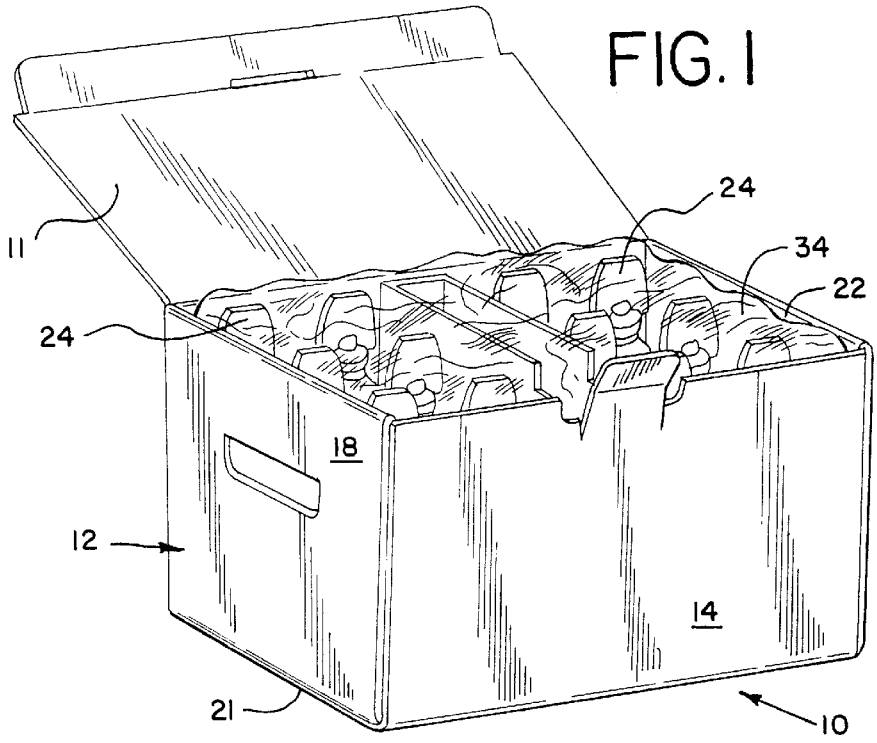
FIG. 1 is a perspective view of the combination package/disposable cooler constructed in accordance with the present invention in use as a point-of-purchase package.
Figure 2:
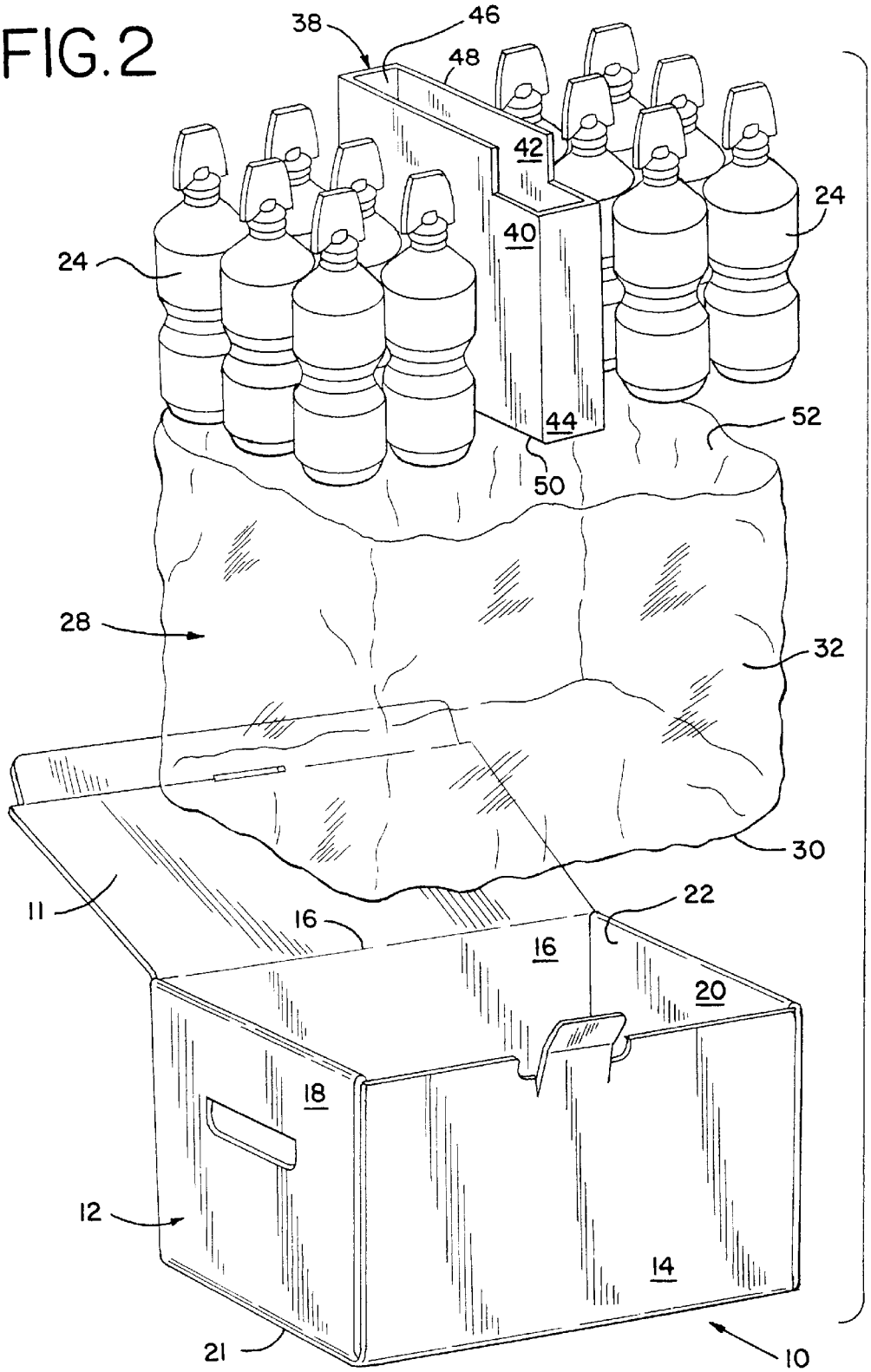
FIG. 2 is an exploded view of the combination package/disposable cooler of FIG. 1.

FIGS. 1 and 2 depict a combination package/disposable cooler 10 constructed in accordance with the present invention. More particularly, FIG. 1 depicts the package 10 as it would appear at the point-of-purchase except that the top flap 11 of the package 10 has been lifted up into its open position to allow the view of the interior thereof for the purpose of describing the structure of the present invention.

The package 10 of the present invention includes an outer container 12 such as a box or the like which, in the embodiment shown, is made of a corrugated paper blank which has been appropriately folded to include opposed, parallel front and back walls 14 and 16, opposed parallel side walls 18 and 20 and a bottom wall 21 together defining a container interior 22 sized to receive the articles stored therein.

In the embodiment shown, the container 12 is generally rectangularly shaped and sized to store therein a plurality of elongate plastic beverage containers such as bottles 24 or the like in an adjacent and abutting row and column relationship where the bottom of the bottles 24 are seated against the interior face of the bottom wall 21 of the container 12. As explained above, however, it is understood that the container 12 may be constructed of any other suitable material and further that the container 12 can be sized to receive differently shaped and sized bottles or the like articles.

The top flap 11, in the embodiment shown, is hingedly connected about the top peripheral edge of the back wall 16 of the container 12 and is adapted to be rotated towards and into abutting relationship with the top peripheral edge of the opposed front wall 14 of the container 12 to close the container 12 and thus provide for the secure shipment of the articles contained, therein.

Figure 3:
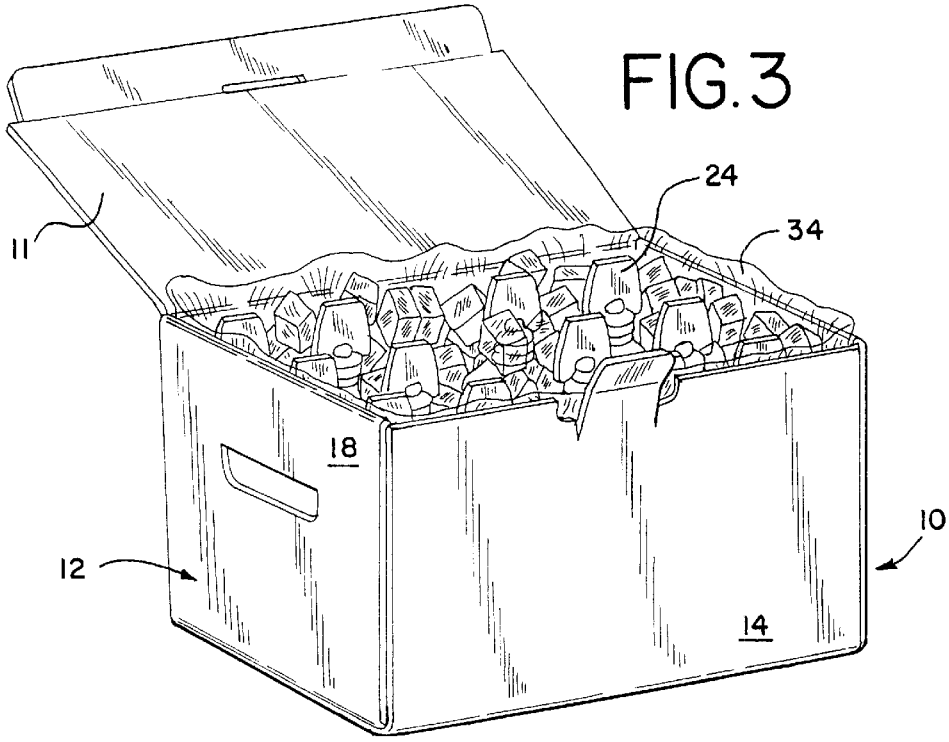
FIG. 3 is a perspective view of the combination package/disposable cooler of the present invention in use as a disposable cooler.

The package 10 also comprises a liner 28 in the form of a bag which includes a closed bottom 30, a mid-portion 32 and a top 34 which is shown in its cinched closed position in FIG. 1 and its open access position in FIG. 3. The liner 28 envelops and surrounds the bottles 24 and is seated and received in the interior 22 of the container 12 in a relationship wherein the bottom 30 of the liner 28 is in abutting relationship with the interior face of the bottom wall 21 of the container 12 and the mid-portion 32 of the liner 28 is in generally abutting relationship with the walls 14, 16, 18 and 20 of the container 12. In the embodiment shown, the liner 28 is made of a flexible and pliable liquid impervious material such as plastic or the like. The bottles 24, in turn, are seated and enveloped around the liner 28 within the interior 22 of the container 12. Alternatively, the liner 28 can be a liquid impermeable or liquid resistant coating on the interior walls of container 12.

The package 10 additionally comprises a spacer 38 which, in the embodiment shown, is made of a sheet of corrugated material which has been, folded in such a manner as to include opposed, spaced and parallel elongate side walls 40 and 42 and front and back elongate walls 44 and 46 together defining a generally circumferentially extending top peripheral edge 48 and a generally circumferentially extending bottom peripheral edge 50. The spacer 38 separates the bottles 24 in the container 12 into two groups and is seated and received centrally in the interior 22 of the container 12 in a relationship wherein the front and back walls 44 and 46 of the spacer 38 are in substantially parallel and abutting relationship with the mid-portion 32 of the liner 28 and the front and back walls 14 and 16 respectively of the container 12. The bottom peripheral edge 50 of the spacer 38 is in an abutting relationship with the bottom 30 of the liner 28 and the interior face of the bottom wall 21 of the container 12. Moreover, the side walls 40 and 42 of the spacer 38 abut the sides of the separated bottles 24.

The volume occupied by the spacer 38 is at least about 10 percent of the total interior volume of the container 12, preferably about 13 to about 20 percent of the total interior volume of the container 12.

Figure 4:
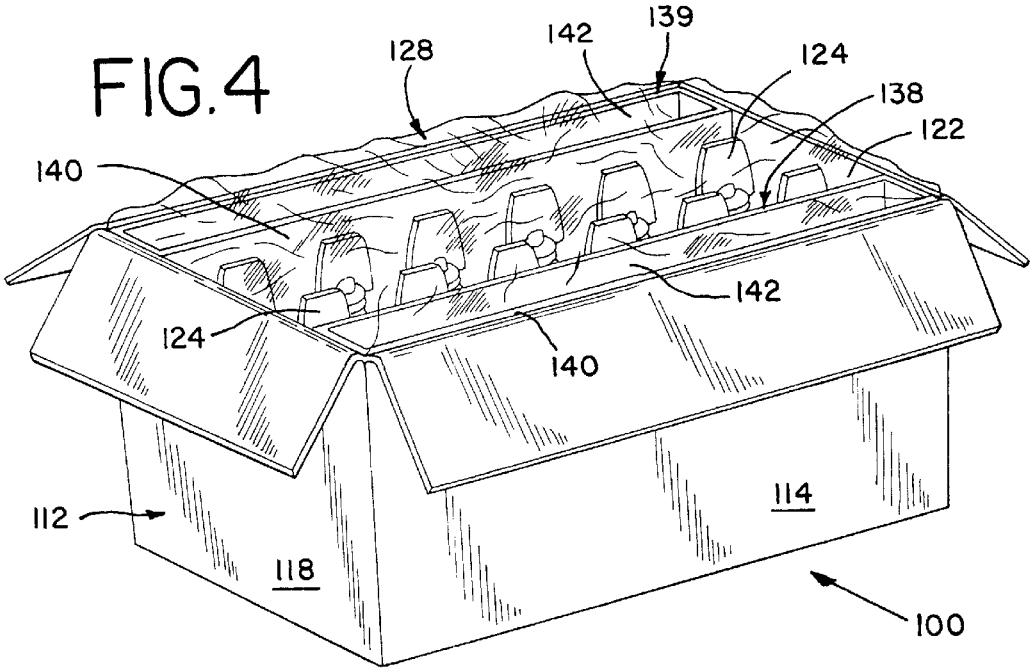
FIG. 4 is a perspective view of an alternate embodiment of the combination package/disposable cooler of the present invention in use as a point-of-purchase package.
Figure 5:
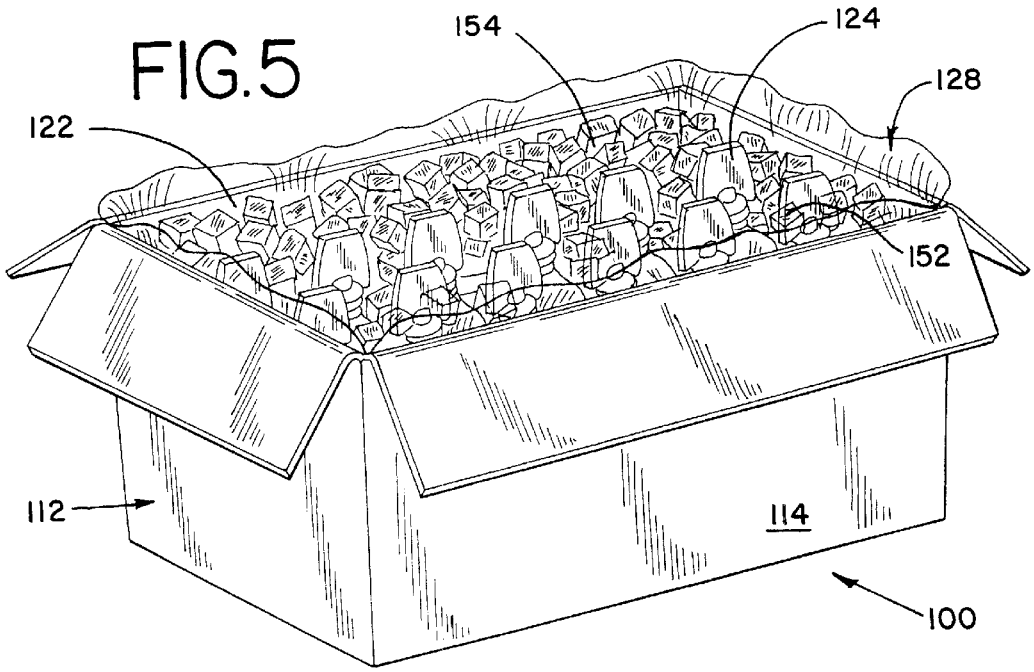
FIG. 5 is a perspective view of the combination package/disposable cooler of FIG. 4 in use as a disposable cooler.

It is understood, of course, that FIGS. 1 and 2 disclose only one embodiment of the spacer 38 and that the invention encompasses spacers of different shapes, sizes and configuration such as, for example, the spacers shown in FIGS. 4 and 5.

As shown in FIG. 3, the package 10 is adapted for use not only as a point-of-purchase package but also as a disposable cooler at the point of use such as, for example, an outdoor event or other like activity where it is preferable that the contents of the package be cooled prior to consumption.

Thus, in accordance with the present invention, the container 12 may be used as a disposable cooler simply by lifting open the flap 11 of the container 12, opening the top 34 of the liner 28, removing the spacer 38 and then placing ice or the, like cooling medium, for example, refreezable ice packs, dry ice, etc., into the space or volume 52 created in the interior 22 between the bottles 24 as a result of the removal of the spacer 38. According to the present invention, the liquid impervious construction of the liner 28 keeps the container 12 dry while the bottles 24 are being cooled by the cooling medium contained therewithin. After the contents of all of the bottles 24 have been consumed, the container 12 and its liner 28, being made of disposable material, can simply be disposed of.

FIGS. 4 and 5 depict an alternate packaging embodiment 100 according to the present invention which comprises a container 112 and a liner 128 similar in structure to the container 12 and the liner 28 of the package 10 except that the container 112 is shaped and structured to receive and store a total of twelve elongate bottles 124 in two rows instead of three rows as in the container 12. Additionally, and unlike the package 10 which includes only one spacer 38 therein, the package 110 includes two spacers 138 and 139 which are adapted to be seated and received within the interior 122 of the container 112 in an orientation and relationship wherein, the spacer 138 is disposed lengthwise in the container 112 with the side wall 140 thereof in abutting relationship against the liner 128 and interior face of the front wall 114 of the container 112, and the side wall 142 in abutting relationship with the side of the bottles 124.

The spacer 139, on.the other hand, is disposed lengthwise in the container 112 opposite and parallel to the spacer 138 in an orientation and relationship wherein the side wall 142 of the spacer 139 is disposed in abutting relationship against the liner 128 and interior face of the back wall 116 of the container 112 and the side wall 140 of the spacer 139 is disposed in abutting relationship with the side of the bottles 124. In accordance with the present invention and the alternate package embodiment 100, the spacers 138 and 139 are adapted to be removed in a manner similar as that described above with respect to the spacer 38 to create two gaps or volumes 152 and 154 in the interior of the liner 128 which can be filled with ice or the like cooling medium for cooling the bottles.

What has thus been described is a package which is adapted and structure for use not only as a point-of-purchase storage package but also as a disposable point-of-use cooler.

From the foregoing description of two alternate embodiments of the package of the present invention, it will be observed that numerous variations and modifications.may be effected to the structure of the container, liner, and spacers without departing from the true spirit and scope of the novel concepts of the invention. It is to be understood, however, that no limitation with respect to the specific package, liner, or spacer illustrated herein is intended or should be inferred. It is, of course, intended to cover by the appended claims all such modifications as fall within the scope of the claims.

I claim:

1. A combination point-of-purchase package and point-of-use disposable cooler adapted to contain beverage containers and comprising a box made of a disposable material and defining an interior, and a liquid impervious liner in the interior which defines a volume for receiving a cooling medium for cooling the contents of the beverage containers adapted to be contained therein, said volume being maintained by a removable spacer located in said interior in abutting relationship with the sides of the beverage containers adapted to be contained therein; wherein said removable spacer is adapted to be removed therefrom prior to the introduction of the cooling medium therein, and wherein said box and said spacer are made of corrugated paper and said spacer has been folded in such a manner as to include opposed, spaced and parallel elongate side walls and opposed, spaced and parallel elongate front and back walls together defining a hollow box.

2. The combination package/disposable cooler of claim 1 wherein said box includes front and back walls and a bottom wall and said spacer is disposed centrally in said interior and extends between said front and back walls and said bottom wall.

3. The combination package/disposable cooler of claim 1 further including more than one spacer located in said interior.

4. The combination package/disposable cooler of claim 1 wherein the spacer occupies at least about 10 percent of the interior volume of the box.

5. The combination package/disposable cooler of claim 1 wherein the spacer occupies about 13 to about 20 percent of the interior volume of the box.

6. A disposable cooler for a pack of bottles and comprising:

a container defining an interior and made of a disposable material;

a separate inner, liquid impervious disposable liner in said container and enveloping the bottles to be cooled, said liner including a top which defines an access opening for the introduction of a cooling medium into said liner and around the bottles to be cooled; and a removable spacer in said interior of said container for creating a space in said cooler between bottles contained therein and adapted to receive the cooling medium when said spacer is removed from said container; wherein said container includes front and back walls and a bottom wall and said spacer is centrally disposed in said interior and extends between said front and back walls and said bottom wall.

7. The disposable cooler of claim 6 further including another spacer in said interior, said container including front and back walls and a bottom wall; both said spacers being disposed in an opposed and parallel relationship lengthwise against said liner and said front and back walls and said bottom wall respectively.

8. A disposable cooler for a pack of bottles and comprising:

a container defining an interior and made of a disposable material;

a separate inner, liquid impervious disposable liner in said container and enveloping the bottles to be cooled, said liner including a top which defines an access opening for the introduction of a cooling medium into said liner and around the bottles to be cooled; and a removable spacer in said interior of said container for creating a space in said cooler between bottles contained therein and adapted to receive the cooling medium when said spacer is removed from said container; wherein said container and said spacer are made of corrugated paper.

9. The disposable cooler of claim 8 wherein said liner is a plastic film.

10. The disposable cooler of claim 8 wherein said container and(said spacer include front and back walls respectively, and said spacer is positioned in said container between said front and back walls of said container.

11. The disposable cooler of claim 8 wherein said space is at least about 10 percent of interior volume in the cooler.

12. The disposable cooler of claim 8 wherein said space is at about 13 to about 20 percent of interior volume in the cooler.

* * * * *